US006591075B2

(12) United States Patent
Koiso et al.

(10) Patent No.: US 6,591,075 B2
(45) Date of Patent: Jul. 8, 2003

(54) CLEANING METHOD OF TONER IMAGE CARRYING BODY, CLEANING DEVICE OF THE TONER IMAGE CARRYING BODY AND IMAGE FORMING APPARATUS EQUIPPED THEREWITH

(75) Inventors: Junichi Koiso, Tokyo (JP); Atsushi Ogane, Tokyo (JP); Junichi Hamada, Tokyo (JP); Yukiko Omori, Tokyo (JP); Mitsugu Nemoto, Tokyo (JP); Kazuhiko Sato, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/081,619

(22) Filed: Feb. 20, 2002

(65) Prior Publication Data

US 2002/0150406 A1 Oct. 17, 2002

(30) Foreign Application Priority Data

Mar. 5, 2001 (JP) ..... 2001-059866

(51) Int. Cl.[7] ..... G03C 21/00

(52) U.S. Cl. ..... 399/129; 399/350; 399/351; 430/125

(58) Field of Search ..... 399/129, 349, 399/350, 351, 128, 101, 102; 430/125

(56) References Cited

U.S. PATENT DOCUMENTS 5,671,464 A * 9/1997 Kubota ..... 399/101

FOREIGN PATENT DOCUMENTS

| | | | |
|---|---|---|---|
| JP | 59-26773 A | * | 2/1984 |
| JP | 63-8783 A | * | 1/1988 |
| JP | 5-204279 A | * | 8/1993 |
| JP | 5-241490 A | * | 9/1993 |
| JP | 6-102803 A | * | 4/1994 |
| JP | 08006368 A | | 1/1996 |

* cited by examiner

*Primary Examiner*—Joan Pendegrass
(74) *Attorney, Agent, or Firm*—Squire, Sanders & Dempsey, L.L.P.

(57) ABSTRACT

A cleaning method of a toner image carrying body, includes the steps of: bringing a discharging member formed in a shape of flexible plate having electric conductivity, which is electrically grounded or to which a discharging voltage is applied, into contact with the toner image carrying body, thereby discharging a toner on the toner image carrying body; and operating a cleaning device on the toner image carrying body whereby cleaning the toner.

19 Claims, 3 Drawing Sheets

CLEANING METHOD OF TONER IMAGE CARRYING BODY, CLEANING DEVICE OF THE TONER IMAGE CARRYING BODY AND IMAGE FORMING APPARATUS EQUIPPED THEREWITH

BACKGROUND OF THE INVENTION

The present invention relates to a cleaning method of a toner image carrying body in an image forming apparatus such as a copier, printer or facsimile device, and to a cleaning device and an image forming apparatus.

As an image forming process to form an image onto a recording material by an electro-photographing system, as being well known, a system by which, by conducting the charging processing, exposure processing and developing processing on a photoreceptor, a toner image is formed on the photoreceptor, and the formed toner image is transferred onto the recording material and fixed, thereby, the image is formed, is mainly used. Further, as another image forming process by which the image is formed by the electro-photographing system, there is a system by which, after the toner image is formed on the photoreceptor by the charging processing, exposure processing and developing processing, the formed toner image is transferred onto an intermediate transfer body, and the image is formed by further transferring it from the intermediate transfer body onto the recording material and fixing.

In these image forming processes, a cleaning process to remove an adhered material of toner remaining on the photoreceptor or intermediate transfer body after the transfer is absolutely necessary, and in the conventional cleaning method, a cleaning blade formed of urethane rubber is commonly used.

Because the cleaning method using the cleaning blade has an excellent cleaning performance in a simple structure, it is widely used, however, accompanied by the development of the technology for high image quality to enhance the resolving power of image or sharpness, the necessity to further enhance the cleaning performance is generated, therefore, it is proposed that another auxiliary cleaning means is used in addition to the cleaning blade.

For example, in Japanese publication Tokkaihei No. H8-6368, a cleaning device in which a cleaning brush onto which the voltage is applied, is provided on the upstream side of the cleaning blade, is proposed.

In this proposal, it is conducted that, by the cleaning brush onto which the voltage is applied, the toner is electrostatically separated from the photoreceptor, and a fine particle toner which can not be removed by the cleaning blade which conducts the cleaning by the mechanical scraping force, is removed by the electrostatic force.

However, in the method proposed in Japanese Published Application, because the cleaning brush occupies a large space, the device becomes large, accordingly, when it is assembled in the image forming apparatus, there is a problem that the arrangement of each structural portion of the image forming apparatus is restrained, and whole image forming apparatus becomes large.

Further, as the technology for the high image quality, the polymerized toner is recently remarked, however, there is a problem that, by the technology proposed in the Japanese Published Application, in the image forming process using the polymerized toner, it is difficult to obtain the sufficient cleaning performance.

SUMMARY OF THE INVENTION

The object of the present invention is to solve the problems in the conventional cleaning technology as described above, and to provide a cleaning method which does not occupy so large space, and is appropriate for the downsizing of the image forming apparatus, and a cleaning device and image forming apparatus equipped therewith.

The object of the present invention is attained by any one of the following structures (1) to (26).

(1) A cleaning method of a toner image carrying body which is characterized in that: in a cleaning method of a toner image carrying body, when a discharging member which has the conductivity and is flexible plate-like, and which is electrically grounded or onto which the discharging voltage is applied, is brought into contact with the toner image carrying body, the toner on the toner image carrying body is discharged, and after the discharge, the cleaning is conducted by operating the cleaning means on the toner image carrying body.

(2) A cleaning method of a toner image carrying body according to above (1), wherein the cleaning means is formed of an elastic plate made of resin.

(3) A cleaning method of a toner image carrying body according to above (1) or (2), wherein the discharging member is formed of conductive resin.

(4) A cleaning method of a toner image carrying body according to any one of above (1) to (3), wherein the discharging member is formed of conductive urethane rubber.

(5) A cleaning method of a toner image carrying body according to above (1) or (2), wherein the discharging member is formed of conductive fiber.

(6) A cleaning method of a toner image carrying body according to any one of above (1) to (5), wherein the leading edge of the cleaning means is contacted with the toner image carrying body in the counter direction relative to the moving direction of the toner image carrying body, and the leading edge of the discharging member is contacted with the toner image carrying body in the trailing direction.

(7) A cleaning method of a toner image carrying body according to any one of above (1) to (6), wherein the toner image carrying body is a photoreceptor.

(8) A cleaning method of a toner image carrying body according to any one of above (1) to (7), wherein the toner image carrying body is an intermediate transfer body.

(9) A cleaning method of a toner image carrying body according to any one of above (1) to (8), wherein there is used a pressure means for increasing the contact pressure of the discharging member onto the toner image carrying body.

(10) A cleaning method of a toner image carrying body according to any one of above (1) to (9), wherein the toner image carrying body onto which the polymerized toner is adhered, is cleaned.

(11) A cleaning device of a toner image carrying body which is characterized in that it has: a cleaning means for cleaning the surface of the travelling toner image carrying body; and a discharging member which contacts with the toner image carrying body on the upstream side of the movement direction of the toner image carrying body, and in order to discharge the toner on the toner image carrying body, which is electrically grounded or onto which the discharging voltage is applied, and which is formed of the conductive and flexible plate-like member.

(12) A cleaning device of a toner image carrying body according to above (11), wherein the cleaning means is formed of a resin made plate having the elasticity.

(13) A cleaning device of a toner image carrying body according to above (11) or (12), wherein the discharging member is formed of the conductive resin.

(14) A cleaning device of a toner image carrying body according to any one of above (11) to (13), wherein the discharging member is formed of the conductive urethane rubber.

(15) A cleaning device of a toner image carrying body according to above (11) or (12), wherein the discharging member is formed of the conductive fiber.

(16) A cleaning device of a toner image carrying body according to any one of above (11) to (15), wherein the leading edge of the cleaning means contacts with the toner image carrying body in the counter direction of the moveing direction of the toner image carrying body, and the leading edge of the discharging member contacts with the toner image carrying body in the trailing direction.

(17) A cleaning device of a toner image carrying body according to any one of above (11) to (16), wherein the cleaning device of a toner image carrying body cleans the photoreceptor as the toner image carrying body.

(18) A cleaning device of a toner image carrying body according to any one of above (11) to (17), wherein the cleaning device of a toner image carrying body cleans the intermediate transfer body as the toner image carrying body.

(19) A cleaning device of a toner image carrying body according to any one of above (11) to (18), wherein the cleaning device of a toner image carrying body has the pressure means by which the discharging member increases the contact pressure onto the toner image carrying body.

(20) A cleaning device of a toner image carrying body according to any one of above (11) to (19), wherein the cleaning device of a toner image carrying body has a conductive support means for supporting the discharging member, and the discharging member is fixed on the conductive support means by a conductive adhering means.

(21) A cleaning device of a toner image carrying body according to above (20), wherein the conductive adhering means is a conductive both-side adhesive tape.

(22) A cleaning device of a toner image carrying body according to any one of above (11) to (19), wherein the cleaning device of the toner image carrying body cleans the toner image carrying body on which the polymerized toner is carried.

(23) A cleaning device of a toner image carrying body according to any one of above (11) to (22), wherein the cleaning device of the toner image carrying body has a conveying means for conveying the toner scraped off by the cleaning, which is arranged between the discharging member and the cleaning means.

(24) An image forming apparatus which is characterized in that it has: the toner image carrying body; the toner image forming means for forming the toner image by using the polymerized toner on the image carrying body; a transfer means for transferring the toner image onto a recording sheet; and the cleaning device according to any one of above (11)–(23).

(25) An image forming apparatus according to above (24), wherein the toner image carrying body includes the photoreceptor.

(26) An image forming apparatus according to above (24) or (25), wherein the toner image carrying body includes the intermediate transfer body.

DETAILED DESCRIPTION OF THE PREFERRED EMBODIMENT

Figure 1:
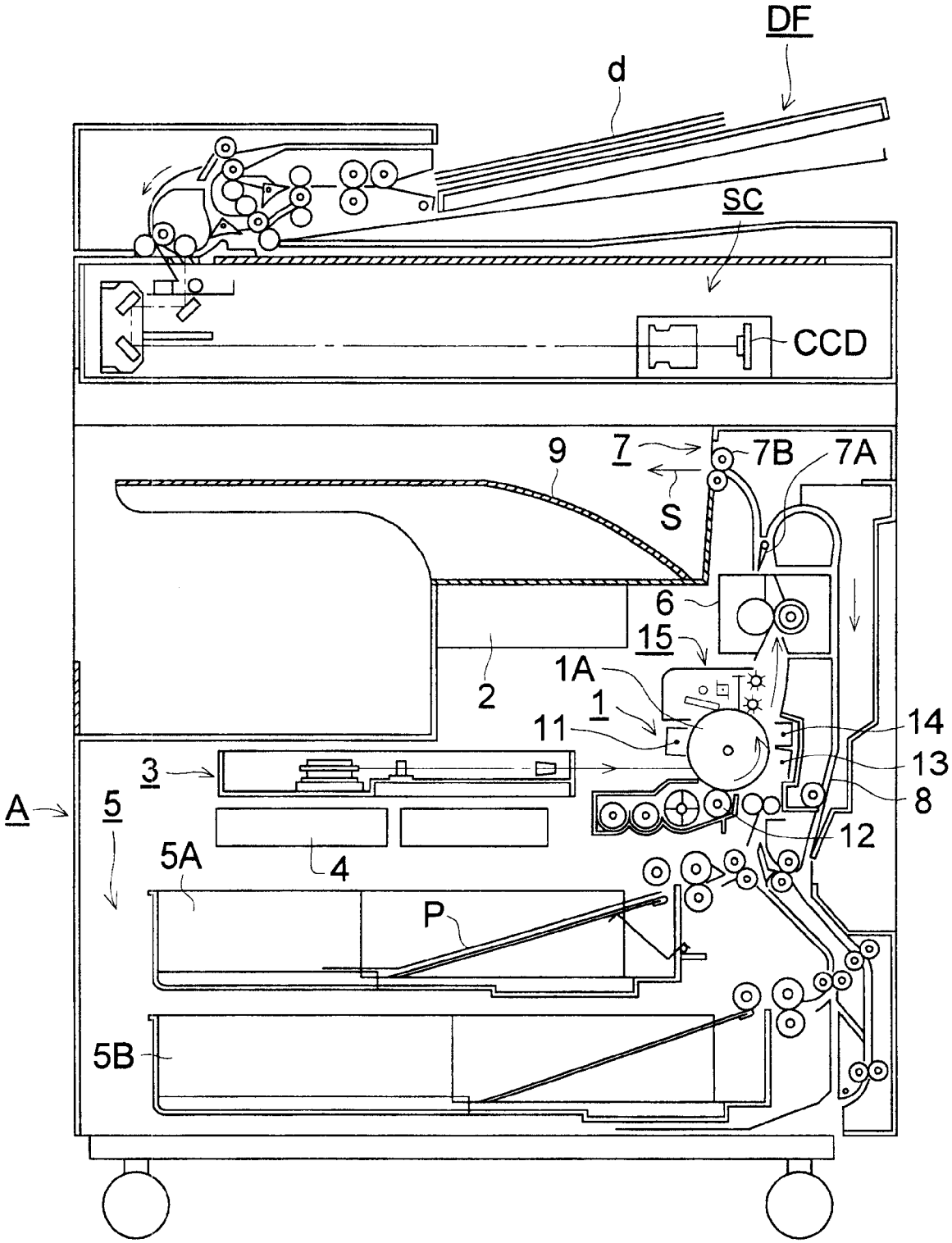
FIG. 1 is a view showing the overall structure of an image forming apparatus according to the embodiment of the present invention.

Next, referring to the drawings, an image forming apparatus according to the embodiments of the present invention will be described.

FIG. 1 shows the overall structure of an image forming apparatus A, and the image forming apparatus A is provided with: an automatic document feeder DF; image reading device SC; image forming section 1; image processing section 2; image exposure device 3; high voltage power source section 4; sheet feed conveying section 5 having sheet feed cassettes 5A, 5B accommodating recording sheets P; fixing device 6; sheet delivery section 7; re-conveying means (ADU) 8 for an automatic double-sided copy; and sheet delivery tray 9.

A document "d" placed on the document table of the automatic document feeder DF is conveyed in the arrowed direction, and by the image reading device SC having an image sensor CCD, an image of a single side or double sides of the document is read.

A photo-electrically converted analog signal by the image sensor CCD is, in the image processing section 2, processed by an analog processing, A/D conversion, shading correction, and image compression processing, and after that, it is stored in a memory, and the image data stored in the memory is used for the light emission control of the image exposure device 3 at the image formation time.

In the image exposure device 3, the output light from a semiconductor laser irradiates the photoreceptor 1A as a toner image carrying body of the image forming section 1, and forms a latent image. For the drum-like photoreceptor 1A, a widely known and arbitrary one such as an OPC photoreceptor, or a-Si photoreceptor, is used. In this connection, as the photoreceptor, it is not limited to the drum-like one, but a belt-like one can also be used. The photoreceptor 1A is rotated in the arrowed direction. Onto the rotating photoreceptor 1A, a charger 11 gives an electric charge, the image exposure device 3 conducts the image exposure, an electrostatic latent image formed by the exposure is developed by a developing device 12, and the toner image is formed on the photoreceptor 1A surface. The recording sheet P fed from the sheet feed cassette 5A, or 5B of the sheet conveying section 5 is conveyed between a transfer device 13 and the photoreceptor 1A, and the toner image is transferred onto the recording sheet P by the transfer device 13. Next, the recording sheet P is separated from the photoreceptor 1A by a separation device 14, and the recording sheet P onto which the toner image is transferred, is fixing processed by the fixing device 6, and delivered from the sheet delivery section 7 onto the sheet delivery tray 9 by a sheet delivery roller 7B. Further, the recording sheet P whose single side image is processed, which is sent to the re-conveying means 8 by a delivery sheet switching member 7A, is rear surface image forming processed in the image forming section 1 again, fixing processed by the fixing device 6, and delivered from the sheet delivery section 7 onto the sheet delivery tray 9 by a sheet delivery roller 7B.

The photoreceptor 1A whose toner image is transferred on the recording sheet P is cleaned by a cleaning device 15 (detailed in FIG. 2), and is in the condition that it can be ready for the next image forming process.

Next, the cleaning device 15 to clean the photoreceptor 1A will be described.

Figure 2:
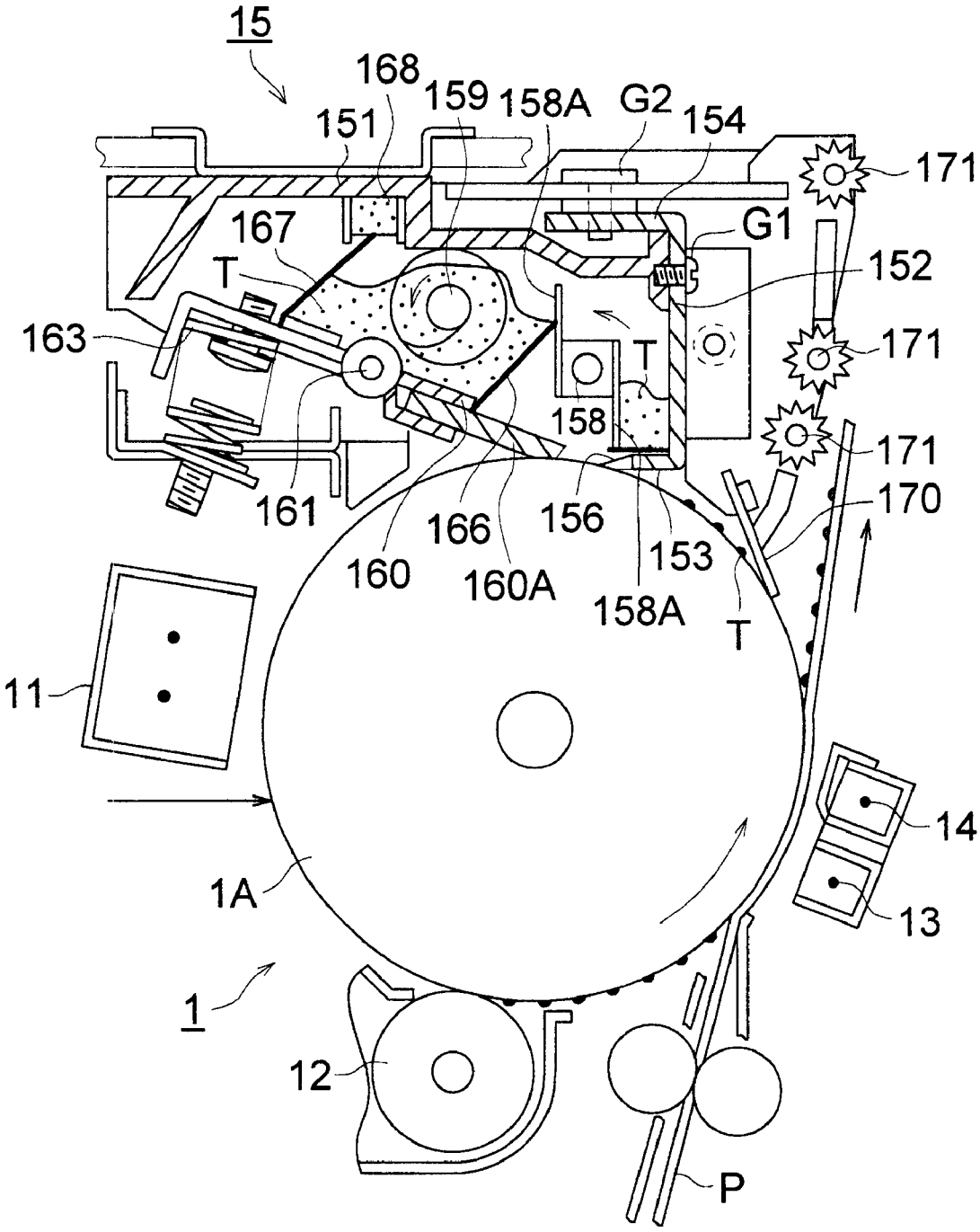
FIG. 2 is a view showing the details of an image forming section.
Figure 3:
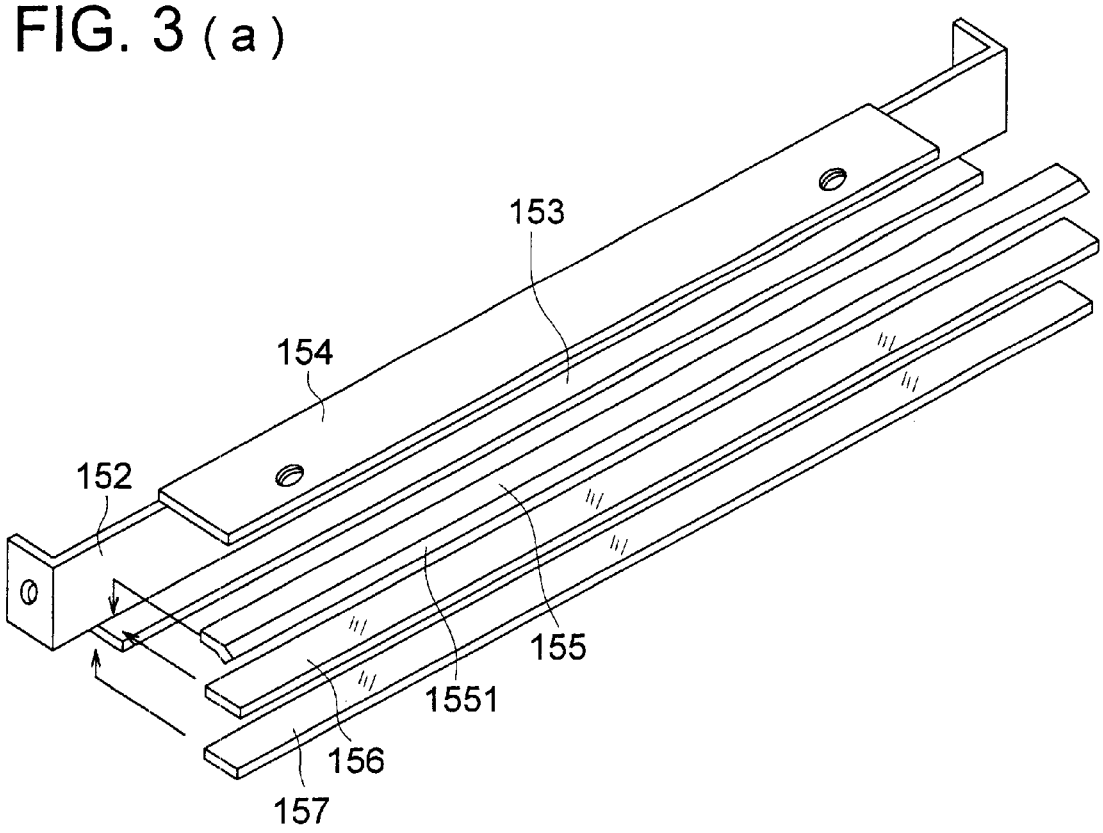
FIGS. 3(*a*) and 3(*b*) are views for explaining the support structure of a discharging member.
Figure 3:
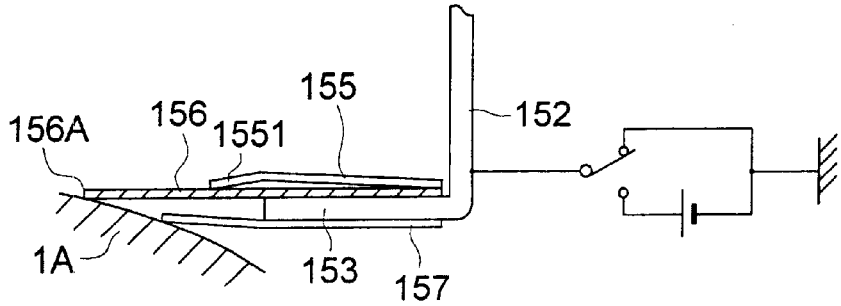

FIG. 2 is a view showing the detail of the image forming section. FIGS. 3(*a*) and 3(*b*) are views for explaining the support structure of a discharging member.

The cleaning device 15 is provided above the photoreceptor 1A. In a cleaning device frame 151 of the cleaning device 15, a support frame 152 as a conductive support means, that is, the support frame 152 which is made of metal and conductive and whose cross section is U-shape, having bend portions 153 and 154, is formed over the entire range in the rotation axis direction of the photoreceptor 1A, and is fixed by screws G1 and G2 on the cleaning device frame 151. Further, as shown in FIGS. 3(*a*) and 3(*b*), a toner guiding plate 157 formed of PET material is fixed by the adhesive agent on the lower surface section of the bend portion 153 so that, over the entire range in the rotation axis direction of the photoreceptor 1A, its leading edge comes in contact with the photoreceptor 1A. Further, a discharging member 156 which is conductive and flexible plate-like, is fixed on the upper surface portion of the bend portion 153 by the conductive adhering means such as the conductive adhesive agent, or conductive both-side tape, so that, over the entire range in the rotation axis direction of the photoreceptor 1A, its leading edge comes in contact with the photoreceptor 1A. Further, the discharging member 156 is electrically grounded through the conductive adhering means and the support frame 152. In this connection, the discharging voltage whose polarity is opposite polarity to the charge polarity of the toner, for example, positive polarity to the negatively charged toner, may also be applied onto the support frame 152.

Further, when, on the discharging member 156, a back supporting member 155 as an elastic pressure means forming a bend portion 1551 is fixed by the adhesive agent, the discharging member 156 comes into contact with the photoreceptor 1A with the desired appropriate contact pressure. As shown by an arrow in FIG. 3(*a*), the bend portion 1551, discharging member 156, and toner guiding plate 157 are assembled and fixed onto the bend portion 153.

A cleaning blade 160 as the cleaning means for cleaning the photoreceptor 1A after the transfer is formed of a resin made plate, preferably a urethane rubber plate, and is arranged so that, in the rotation direction downstream side of the photoreceptor 1A, its leading edge 160A comes into contact with the discharging member 156. As shown in the drawing, the discharging member 156 forms the sharp angle in the trail direction, that is, in the rotation direction upstream side of the photoreceptor 1A, and it comes into contact with the photoreceptor 1A, so that the pulling force acts on the leading edge portion 156A (shown in FIG. 3(*b*)), at the time of rotation of the photoreceptor 1A. Then, the cleaning blade 160 forms the sharp angle in the counter direction, that is, in the rotation direction downstream side of the photoreceptor 1A, and it comes into contact with the photoreceptor 1A so that the compression force acts on the leading edge portion 160A at the time of rotation of the photoreceptor 1A.

The base portion of the cleaning blade 160 is fixed to a support plate 162, and the support plate 162 is rotatably supported on an axis 161. The support plate 162 is urged by a spring 163, and a desired contact pressure is given to the cleaning blade 160.

Above the discharging member 156 and the cleaning blade 160, a conveying member 158 as the conveying means is provided. The conveying member 158 is rotated as shown by an arrow, and by 2 conveying blades 158A, the toner scraped by the cleaning blade 160 from the photoreceptor 1A is conveyed to a conveying screw 159. Numeral 166 is a scraper to scrape off the toner adhering to the conveying blades 158A. The conveying screw 159 conveys the toner conveyed from the conveying member 158 to the depth direction of the drawing by its rotation. A portion of the conveying screw 159 is formed as a toner accommodation chamber by a scraper 166, separation plate 167, and a seal member 168 with which the leading edge portion of the separating plate 167 contacts, and the conveying screw 159 conveys the toner in this toner accommodation chamber. The seal member 168 is structured by Moltprene, and accommodates the toner sent by the conveying member 158 so as not to scatter. Numeral 170 is a separation member to separate the recording sheet P from the photoreceptor, and numeral 171 is a guide member to guide the recording sheet P after the separation.

The cleaning operation of the cleaning device 15 described above is as follows. When the photoreceptor 1A carrying the residual toner T after the transfer passes the discharging member 156, the discharging member 156 discharges the residual toner T. By this discharging, the attractive force of the residual toner T to the photoreceptor 1A is reduced.

The cleaning by the cleaning blade 160 is mainly the mechanical scraping operation of the edge of the leading edge 160A, and for the electrostatically attracted fine particle toner, by so called pass-through, the phenomenon that it can not be cleaned by the cleaning blade 160, is generated, however, when the residual toner is discharged by the discharging member 156 as described above, the pass-through is prevented, and the very fine cleaning is performed.

The discharging member 156 is made of metal and electrically grounded through the conductive support frame 152, but, the discharging voltage whose polarity is opposite to the charging polarity of the toner, may be applied onto the discharging member 156.

As the discharging member 156, the discharging member which has the conductivity and is a flexible plate-like and which does not damage the photoreceptor 1A, is used.

As a preferable material of the discharging member 156, there is the following:

(1) conductive urethane rubber, or conductive resin such as conductive polyethylene; and (2) conductive fiber.

As the conductive fiber, there are copper acrylic fiber (for example, NAM 002, NEA 003, NET 003 made by Achilles Co.), carbon fiber, stainless fiber, magnesium fiber, or aluminum fiber.

The above-described conductive discharging member is a member having the conductivity showing the surface resistance not larger than $10^{12}$ Ω/square is preferable, and specially, a member having the conductivity showing the surface resistance of $10^3$ to $10^8$ Ω/square is preferable. When the surface resistance exceeds $10^{12}$ Ω/square, the discharging performance is lowered and the cleaning performance is lowered.

Further, the meaning of the flexible plate-like is that the member has the bending property to the applied force onto the plate-like member, and to the pressure applied onto the plate-like member, the member has the characteristic to be compressed, that is, the compressibility. By this compressibility, it is prevented to damage the photoreceptor 1A with which the discharging member contacts.

The present embodiment solves the problem of the cleaning which is difficult in the image forming process using the polymerized toner. The polymerized toner is a toner produced by the polymerization method, and has the excellent characteristic that it has a narrow and sharp peak to the particle distribution and charging amount distribution, or the similar characteristic. Further, it has the characteristic that it is a fine particle and appropriate for forming the image with the high resolving power. As the preferable particle size, it is 3–9 $\mu$m in the weight average particle size.

In the conventional image formation, by pulverizing and classifying the resin, a pulverized toner in which the toner particle having a predetermined particle size is formed and produced, is used.

In the present embodiment, it is preferable that the polymerized toner in which the toner particle is formed and produced by the polymerization method, is used.

The polymerized toner is well known from many patent gazettes or other references, and it means the toner in which the generation of the binder resin for toner and the toner shape are formed and obtained by the material monomer of the binder resin, or the polymerization of the pre-polymer and the chemical processing after that. More specifically, it means the toner obtained through the polymerization reaction such as the suspension polymerization or emulsion polymerization, and the fusing process of each other particles conducted after that at need. In the polymerized toner, because the material monomer or pre-polymer is uniformly dispersed in the water system, after that, it is polymerized and the toner is produced, the toner having the uniform particle size distribution and shape is obtained.

The embodiment described above is an example that the photoreceptor is cleaned, however, the image forming apparatus according to the present invention also includes the image forming apparatus having the intermediate transfer body, and the cleaning method according to the embodiment of the present invention can also be used for the cleaning of the intermediate transfer body which carries the toner image transferred from the photoreceptor.

EXAMPLE

By using Konica 7030 copier made by Konica Corp, the measurement of the surface potential of the photoreceptor and the image forming test are conducted. In the image forming test, the polymerized toner of the weight average particle size 6.5 $\mu$m is used, and the line speed of the photoreceptor is made 180 mm/sec, and the developing bias voltage is made—400 V.

After transfer, the surface potential of the photoreceptor after the transfer is measured in an example of a case in which the discharging member of the conductive urethane rubber whose thickness is 200 $\mu$m and free length is 8 mm,(conductive urethane rubber made by Hokushin Kogyo Co., the surface resistance $7\times10^3$ Ω/square) is used for the photoreceptor and is contacted with it, and in a comparative example of a case in which the discharging member is not used.

TABLE 1

| | Photoreceptor First rotation | Photoreceptor Second rotation | Photoreceptor Third rotation |
|---|---|---|---|
| Comparative (photoreceptor surface potential in the case of no discharging member) | −65 V | −165 V | −295 V |
| Inventive (photoreceptor surface potential in the case of use of discharging member) | −50 V | −120 V | −215 V |

TABLE 2

| | Poor cleaning (pass-through) | |
|---|---|---|
| | Inventive example (with discharging member) | Comparative example (without discharging member) |
| $5\times10^4$ copy | good (no pass-through) | 12 sheets/$5\times10^4$ |
| $10\times10^4$ copy | good (no pass-through) | 315 sheets/$5\times10^4$ |
| $15\times10^4$ copy | good (no pass-through) | 512 sheets/$5\times10^4$ |
| $20\times10^4$ copy | good (no pass-through) | 731 sheets/$5\times10^4$ |

Further, the result of the image forming test as shown in Table 2.

The number of sheets in the comparative example in Table 2 shows the number of sheets of the generation of the poor cleaning in $50\times10^3$ sheet copy.

As can be clearly sheen from Table 1, the surface potential of the photoreceptor is lowered by the discharging member (lowering in the absolute value), as the result, the good cleaning performance as shown in Table 2 is obtained. In contrast to this, in the conventional example without the discharging member, the poor cleaning is generated.

According to Structures (1), (2), (6), (7), (8), (11), (12), (16), (17), (18), (24), (25), or (26), also in the image formation using the polymerized toner, the poor cleaning due to the pass-through is not generated over the long time, and the good cleaning performance is maintained. As the result, the high quality image having the high resolving power and high sharpness, can be stably formed. Furthermore, when the discharging member is provided, because the space occupied by the cleaning device is not increased, the arrangement of the cleaning device is not restricted, thereby, the size of the image forming apparatus can be reduced.

According to any invention of Structures (3)–(5), (13)–(15), the surface of the toner image carrying body is not damaged, and the good cleaning can be conducted.

According to Structure (9) or (19), the discharging member can be brought into contact with the toner image carrying body with a predetermined contact pressure, and the best cleaning condition exhibiting the desired cleaning performance can be set.

According to Structure (10) or (22), the image having the excellent image characteristics such as the high resolving power, and high sharpness is formed.

According to Structure (20) or (21), because the discharging member can be electrically grounded through the support means of the discharging member, the structure is not complicated, and the discharging performance of the discharging member becomes uniform over the entire range in which it is brought into contact with the toner image carrying body, thereby, the uniform and stable cleaning performance can be obtained.

According to Structure (23), the toner is removed and recovered from the toner image carrying body, and the whole of cleaning device having the function to collect the recovered toner is structured into the small size.

What is claimed is:

1. A cleaning method of a toner image carrying body, comprising:

(a) bringing a discharging member formed in a shape of flexible plate having electric conductivity, which is electrically grounded or to which a discharging voltage is applied, into contact with the toner image carrying body, thereby discharging a toner on the toner image carrying body; and (b) operating a cleaning device on the toner image carrying body whereby cleaning the toner, wherein a pressure applying device is used for enhancing a contact pressure of the discharging member against the toner image carrying body.

2. The cleaning method of claim 1, wherein the cleaning device is a resilient resin plate.

3. The cleaning method of claim 1, wherein the discharging member is an electrically conductive resin.

4. The cleaning method of claim 1, wherein the discharging member is a electrically conductive urethane rubber.

5. The cleaning method of claim 1, wherein the step of the bringing comprises bringing an end of the discharging member into contact with the toner image carrying body in a trailing direction, and the step of the operating comprises bringing an end of the cleaning device into contact with the toner image carrying body in a counter direction relative to a moving direction of the toner image carrying body.

6. The cleaning method of claim 1, wherein the toner image carrying body comprises a photoreceptor.

7. The cleaning method of claim 1, wherein the toner is a polymerized toner.

8. A cleaning apparatus comprising:

(a) a cleaning device for cleaning a surface of a toner image carrying body which moves;

(b) a discharging member formed in a shape of flexible plate having electric conductivity, which is electrically grounded or to which a discharging voltage is applied, and brought into contact with the toner image carrying body on an upstream side of the cleaning device with respect to a moving direction of the toner image carrying body, for discharging a toner on the toner image carrying body; and (c) a pressure applying device for enhancing a contact pressure of the discharging member against the toner image carrying body.

9. The cleaning apparatus of claim 8, wherein the cleaning device is a resilient resin plate.

10. The cleaning apparatus of claim 8, wherein the discharging member is an electrically conductive resin.

11. The cleaning apparatus of claim 8, wherein the discharging member is a electrically conductive urethane rubber.

12. The cleaning apparatus of claim 8, wherein an end of the discharging member is brought into contact with the toner image carrying body in a trailing direction, and an end of the cleaning device is brought into contact with the toner image carrying body in a counter direction relative to the moving direction of the toner image carrying body.

13. The cleaning apparatus of claim 8, wherein the toner image carrying body is a photoreceptor.

14. The cleaning apparatus of claim 8, further comprising an electrically conductive supporter for supporting the discharging member, and an electrically conductive adhering device for fixing the discharging member to the electrically conductive supporter.

15. The cleaning apparatus of claim 14, wherein the electrically conductive adhering device is a both-sided adhesive tape.

16. The cleaning apparatus of claim 8, wherein the toner is a polymerized toner.

17. The cleaning apparatus of claim 8, further comprising a conveyor arranged between the discharging member and the cleaning device for conveying the toner scraped by the cleaning device.

18. An image forming apparatus comprising:

(a) a toner image carrying body;

(a) a toner image forming device for forming a toner image on the toner image carrying body;

(c) a transfer device for transferring the toner image formed on the toner image carrying body onto a transfer material; and (d) the cleaning device set forth in claim 8.

19. The image forming apparatus of claim 18, wherein the toner image carrying body is a photoreceptor.

* * * * *